US007340782B2

(12) United States Patent
Ortiz

(10) Patent No.: US 7,340,782 B2
(45) Date of Patent: Mar. 11, 2008

(54) TOILET ASSEMBLY

(76) Inventor: Javier Ortiz, 7325 Hollow Ridge Cir., Orlando, FL (US) 32822

( * ) Notice: Subject to any disclaimer, the term of this patent is extended or adjusted under 35 U.S.C. 154(b) by 86 days.

(21) Appl. No.: 10/855,613

(22) Filed: May 28, 2004

(65) Prior Publication Data

US 2005/0262622 A1 Dec. 1, 2005

(51) Int. Cl.
*A47K 13/12* (2006.01)

(52) U.S. Cl. ..... 4/236; 4/234

(58) Field of Classification Search ..... 4/234–237, 4/239, 240, 242.1

See application file for complete search history.

(56) References Cited

U.S. PATENT DOCUMENTS

| | | | | | |
|---|---|---|---|---|---|
| 559,993 | A | * | 5/1896 | Bunting, Jr. | 4/236 |
| 823,275 | A | * | 6/1906 | Henn | 4/236 |
| 2,913,735 | A | * | 11/1959 | Leslie | 4/234 |
| 3,913,150 | A | | 10/1975 | Poister et al. | 4/213 |
| 4,133,062 | A | | 1/1979 | Fulbright, Jr. | 4/246.1 |
| 4,894,870 | A | | 1/1990 | Buchshaw et al. | 4/253 |
| 5,058,528 | A | | 10/1991 | Counseller et al. | 119/165 |
| 5,267,357 | A | | 12/1993 | Ades | 4/240 X |
| 5,400,442 | A | | 3/1995 | Pendleburg | 4/236 X |
| 5,414,875 | A | | 5/1995 | Kappl et al. | 4/236 |
| D377,306 | S | | 1/1997 | Decker | D8/326 |
| 5,794,277 | A | | 8/1998 | Jones | 4/236 |
| 5,980,150 | A | | 11/1999 | Newman et al. | 4/240 X |
| 2003/0167563 | A1 | | 9/2003 | Hinton | 4/484 |
| 2003/0204900 | A1 | | 11/2003 | Hsieh | 4/236 |
| 2004/0045082 | A1 | | 3/2004 | Marras | 4/246.1 |

FOREIGN PATENT DOCUMENTS

| | | |
|---|---|---|
| JP | 8-317877 | 12/1996 |

* cited by examiner

*Primary Examiner*—Robert M. Fetsuga
(74) *Attorney, Agent, or Firm*—Richard C. Litman

(57) ABSTRACT

The toilet assembly includes a toilet seat lid, a toilet seat, a toilet tank, a toilet bowl and a hinge assembly. The toilet seat lid is situated on top of the toilet seat. The toilet seat lid has a front peripheral lid portion and an end portion extended off of the front peripheral lid portion. The toilet seat has a front peripheral seat portion and an end portion extended normal to the front peripheral seat portion. The hinge assembly is affixed to the lid end portion, the seat end portion, and additionally to the front surface of the toilet tank. The seat end portion rises perpendicular to the front peripheral seat portion so that when the toilet seat lid is raised, the hinge assembly is covered, protecting it from exposure to urine.

11 Claims, 6 Drawing Sheets

TOILET ASSEMBLY

BACKGROUND OF THE INVENTION

1. Field of the Invention

The present invention relates to toilet seats, and particularly to a toilet assembly with a toilet seat having a raised backing.

2. Description of the Related Art

Toilet assemblies used in homes typically have a toilet bowl, toilet seat, toilet seat lid, and a toilet tank that flushes waste products. The toilet tank is mounted upon the toilet bowl. The toilet seat lid rests a top the toilet seat. The toilet seat and toilet seat lid are attached with a hinge to the toilet bowl, allowing the seat and lid to be raised or lowered by an individual.

The problem that arises with an assembly such as the one described above is that any attachment from the toilet seat and lid onto the bowl tends to become dirty. Urine and dust often collect about the hinges. Cleaning the area around the hinges is troublesome and difficult for individuals to easily reach.

The related art endeavors to solve the problem of difficult to clean hinges by developing new ways of attaching the seat and seat lid to the toilet assembly.

U.S. Pat. No. 5,267,357, issued Dec. 7, 1993 to B. Ades, shows a releasable toilet lid and seat locking apparatus. The apparatus is attached to the front surface of a toilet flush tank. The apparatus has a rod and hinges that are attachable to the rod. The hinges connect to the toilet lid and toilet seat, allowing the lid and seat to be raised or lowered against the front surface of the toilet flush. The apparatus does not attach to the toilet bowl.

U.S. Pat. Pub. No. US 2004/0045082, published Mar. 11, 2004 and invented by J. Marras, shows a self-supportive toilet seat and cover system. The seat and cover system includes levers attached to the toilet seat and toilet cover by hinges. A user presses downward on the levers, causing either one or both of the seat and cover to raise to a vertical position. The system includes support members that fit within holes in the toilet bowl.

U.S. Pat. Pub. No. US 2603/0204900 A1, published Nov. 6, 2003 and invented by E. Hsieh, shows a toilet seat and toilet cover hinge. A vertical sleeve fits upon a subplate attached to a toilet bowl. Two hinge plates are attached to a shaft connected to the vertical sleeve. One hinge plate is fastened to the toilet seat and the other is attached to the toilet cover.

Other patents showing toilet assemblies or toilet hinges include U.S. Pat. No. Des. 377,306, issued Jan. 14, 1997 to D. Decker (quick-release hinge for toilet seat); U.S. Pat. Pub. No. US 2003/0167563 A1, published Sep. 11, 2003 and invented by S. Hinton (portable lavatory apparatus); U.S. Pat. No. 3,913,150, issued Oct. 21, 1975 to C. Poister et al. (toilet stool ventilating means); U.S. Pat. No. 4,133,062, issued Jan. 9, 1979 to B. Fulbright, Jr. (lifting apparatus for toilet seat); U.S. Pat. No. 4,894,870, issued Jan. 23, 1990 to D. Buckshaw et al. (toilet seat latch); U.S. Pat. No. 5,058,528, issued Oct. 22, 1991 to E. Counseller et al. (cat litter box apparatus and method); U.S. Pat. No. 5,400,442, issued Mar. 28, 1995 to J. Pendleburg (automatic toilet seat and lid lowering device); U.S. Pat. No. 5,414,875, issued May 16, 1995 to F. Kappl et al. (quick release seat latch); U.S. Pat. No. 5,794,277, issued Aug. 18, 1998 to C. Jones (automatic toilet seat closing device); U.S. Pat. No. 5,980,150, issued Nov. 9, 1999 to R. Newman et al. (quarter turn toilet seat pin with threaded lock bolt); and Jap. Pat. No. JP 8-317877, published Dec. 3, 1996 (fitting structure for toilet cover or toilet seat).

Although the related art addresses toilet assemblies or hinge attachments designed to provide for easier cleaning, what is needed is a toilet assembly in which the seat and seat lid are attached to the toilet tank and not the toilet bowl. This assembly would allow the toilet bowl to be easily cleaned. What is further needed is a toilet assembly having a seat and seat lid designed to block the hinge entirely from urine.

None of the above inventions and patents, taken either singly or in combination, is seen to describe the instant invention as claimed. Thus a toilet assembly solving the aforementioned problems is desired.

SUMMARY OF THE INVENTION

The toilet assembly includes a toilet seat lid, a toilet seat, a toilet tank, a toilet bowl and a hinge assembly. The toilet tank has a front surface and a bottom surface. The bottom surface of the tank is attached to the toilet bowl base. The toilet seat lid is situated on top of the toilet seat. The hinge assembly is affixed to the seat lid and the seat, and additionally attached to the front surface of the toilet tank. Thus there is no attachment device on the surface of the toilet bowl to affix the toilet seat or lid to the bowl surface.

The toilet seat lid has a front peripheral portion and an end peripheral portion extended off of the front portion. The toilet seat has a front peripheral portion and an end peripheral portion extended normal to the front seat portion. The seat end portion has a top surface, to which a hinge bracket of the hinge assembly is bolted. One edge of the top surface of the seat end portion is raised slightly higher than the hinge bracket to protect it against exposure to urine.

The hinge assembly is attached to the lid end portion, the top surface of the seat end portion, and the front surface of the toilet tank. The seat end portion rises perpendicular to the front seat portion so that when the toilet seat lid is raised, the hinge assembly is covered. The hinge assembly is thereby protected from urine.

The toilet seat, toilet seat lid and hinge assembly may be an after-market attachment that is secured to an existing toilet bowl and toilet tank. The hinge assembly is attached to the toilet seat and toilet seat lid, then secured to the toilet tank by drilling holes in the existing tank.

Accordingly, it is a principal aspect of the invention to provide a toilet assembly that allows for easy cleaning of the toilet bowl, toilet seat and toilet seat lid. It is another aspect of the invention to conceal the hinge assembly from exposure to urine.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
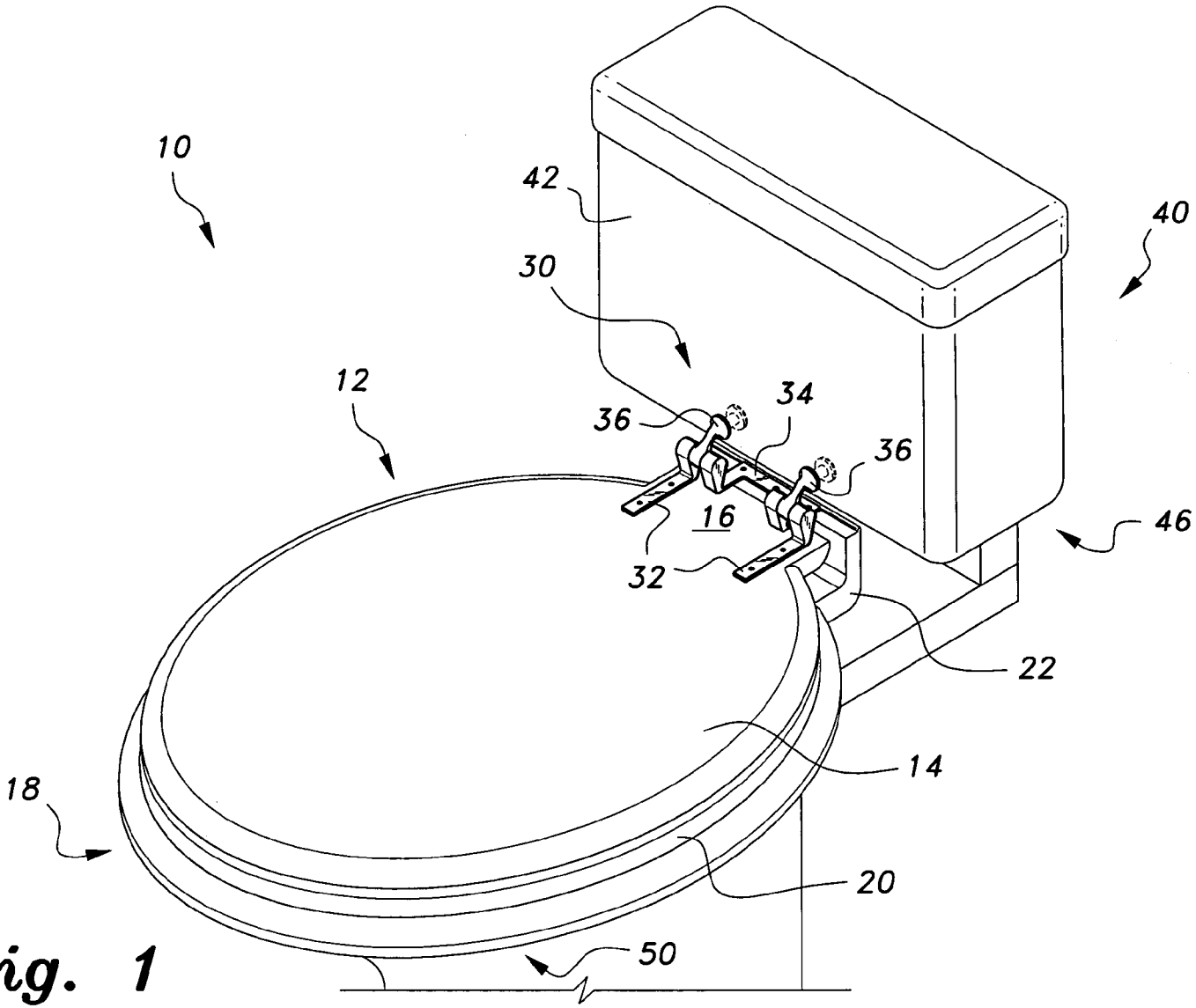
FIG. 1 is an environmental, perspective view of a toilet assembly according to the present invention.

The present invention is a toilet assembly, designated generally as 10 in the drawings. The toilet assembly 10 has a toilet seat lid 12, a toilet seat 18, a toilet tank 40, a toilet bowl 50, and a hinge assembly 30. The hinge assembly 30 is attached to the toilet seat lid 12 and the toilet seat 18. The hinge assembly 30 is additionally attached to the toilet tank 40.

Referring first to FIG. 1, the toilet assembly 10 is shown with the toilet seat lid 12 sitting on top of the toilet seat 18. The toilet seat 18 rests upon the toilet bowl 50. The toilet tank 40 has a front surface 42 and a bottom surface 46. The bottom surface 46 of the tank 40 is attached to the base of the toilet bowl 50. The toilet seat lid 12 has a front peripheral portion 14 and a lid end portion 16 extended off of the front peripheral portion 14. The toilet seat 18 has a front peripheral portion 20 and a seat end portion 22. The seat end portion 22 extends off of the front seat portion 20 and is perpendicular to the front seat portion 20. The seat end portion 22 includes a top surface at an elevation higher than the front peripheral seat portion 20. The hinge assembly 30 is affixed to the lid end portion 16, the seat end portion 22, and the front surface 42 of the toilet tank 40.

Figure 2A:
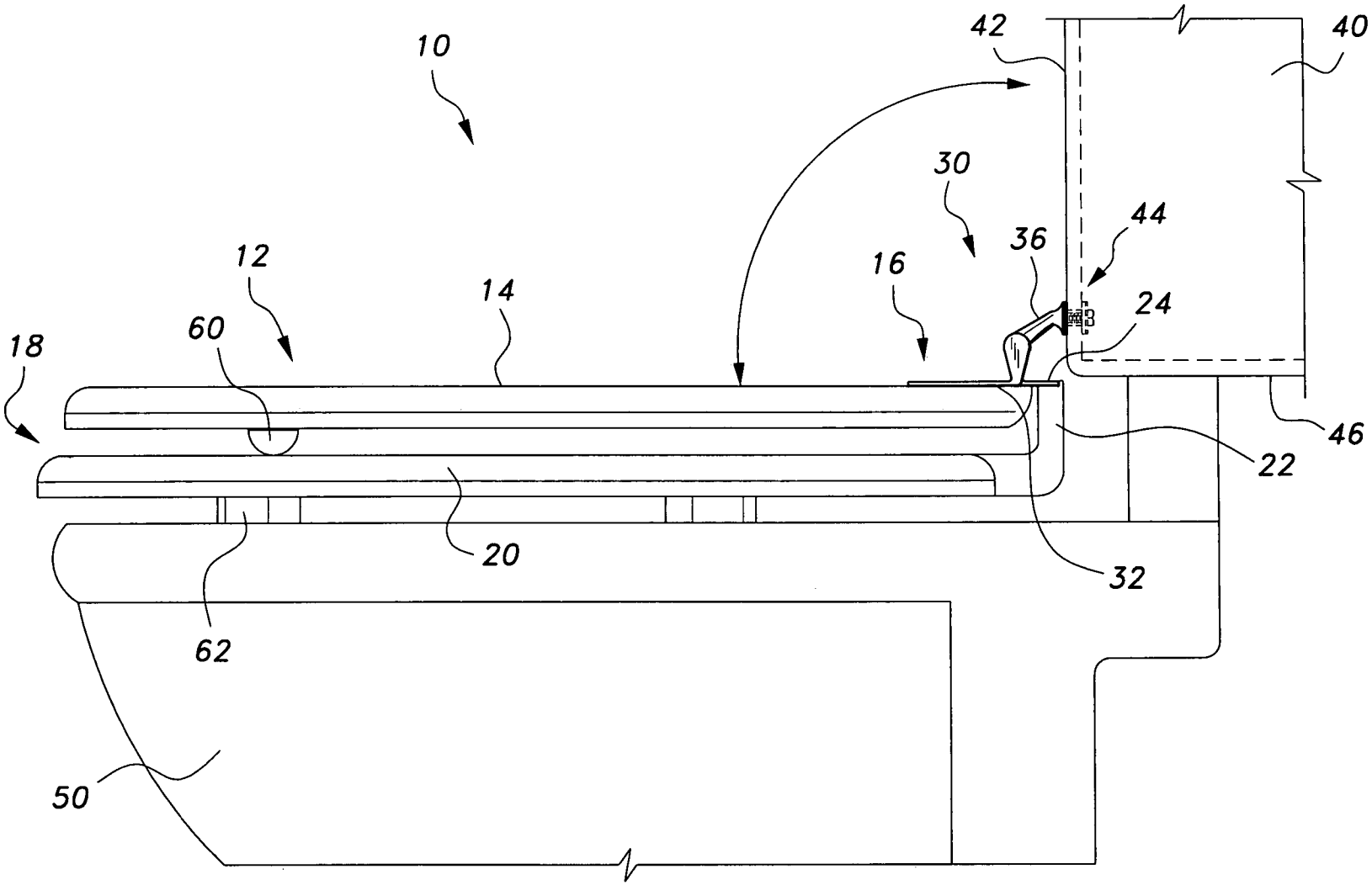
FIG. 2A is an elevational side view of the toilet assembly according to the present invention with the seat lid and seat in a horizontal position.

FIG. 2A shows a side view of the toilet assembly 10 with the toilet seat lid 12 and toilet seat 18 in a horizontal position. The toilet seat lid 12 has a front lid portion 14 and a lid end portion 16. The toilet seat 18 has a front seat portion 20 and a seat end portion 22 extended normal to the front seat portion 20. The hinge assembly 30 has hinge plates 32, a hinge bracket 34 and a pair of mounting attachments 36. The mounting attachments 36 and hinge plates 32 are connected to the hinge bracket 34. The hinge bracket 34 is affixed to the top surface 24 of the seat end portion 22. The hinge plates 32 are bolted onto the lid end portion 16 of the toilet seat lid 12. The mounting attachments 36 are secured within holes 44 on the front surface 42 of the toilet tank 40. The toilet tank 40 is mounted onto the base of the toilet bowl 50.

Lid spacers 60 separate the toilet seat lid 12 from the toilet seat 18. Seat spacers 62 separate the toilet seat 18 from the toilet bowl 50.

Figure 2B:
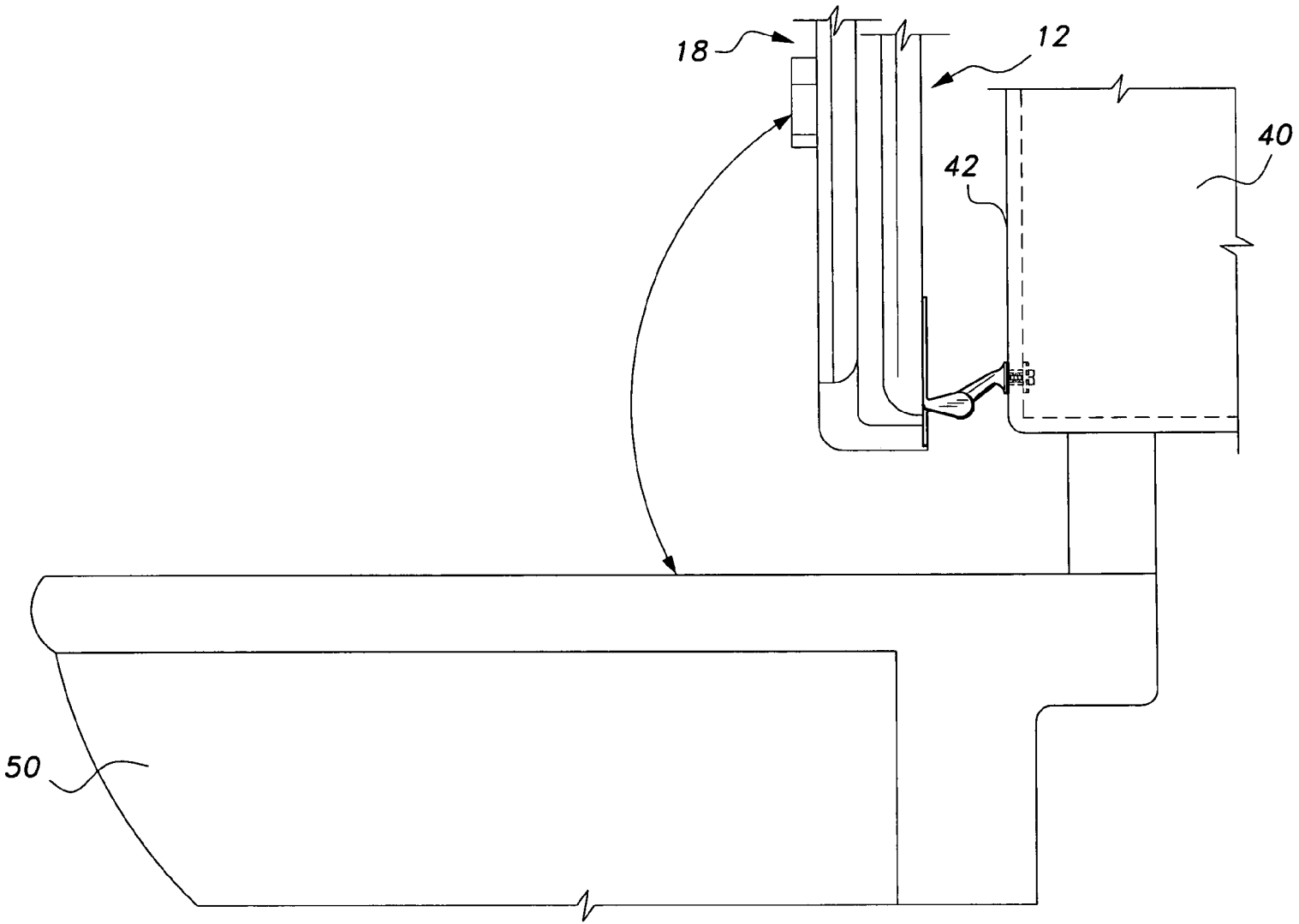
FIG. 2B is an elevational side view of the toilet assembly according to the present invention with the seat lid and seat in a vertical position.

FIG. 2B shows the toilet assembly 10 with the toilet seat lid 12 and toilet seat 18 raised in a vertical position. It can be seen that the toilet bowl 50 lacks mounting holes or hinges to allow for easier cleaning.

Figure 3:
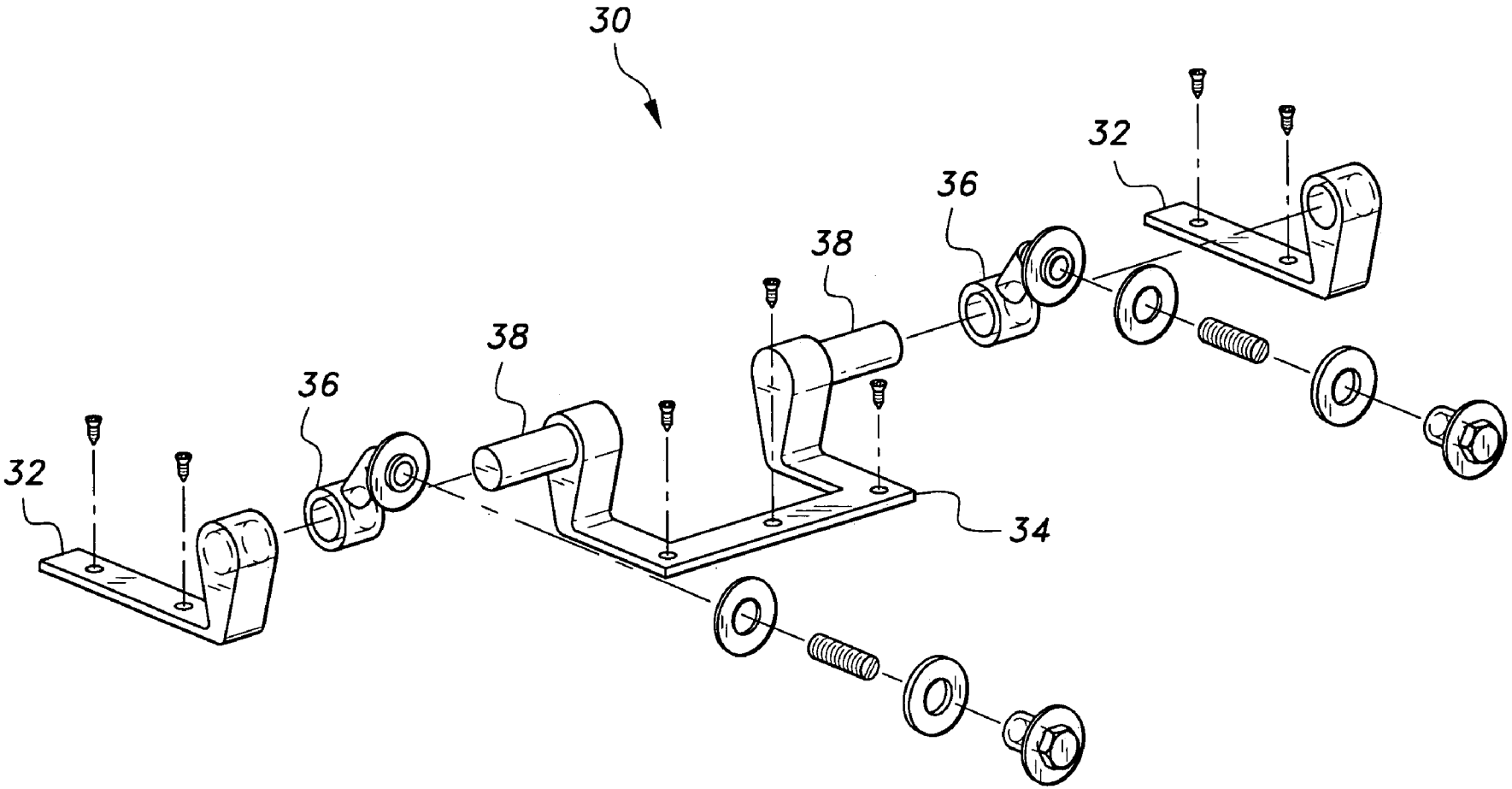
FIG. 3 is an exploded view of the hinge assembly according to the present invention.

FIG. 3 shows an exploded view of the hinge assembly 30. The hinge bracket 34 bolts onto the top surface 24 of the seat end portion 22. The hinge bracket 34 has pivot shafts 38 onto which the hinge plates 32 and the mounting attachments 36 are set. The mounting attachments 36 slide onto the pivot shafts 38 then the hinge plates 32 slide onto the pivot shafts 38. The hinge plates 32 affix to the toilet seat lid 12. The mounting attachments 36 bolt into the toilet tank 40.

Figure 4:
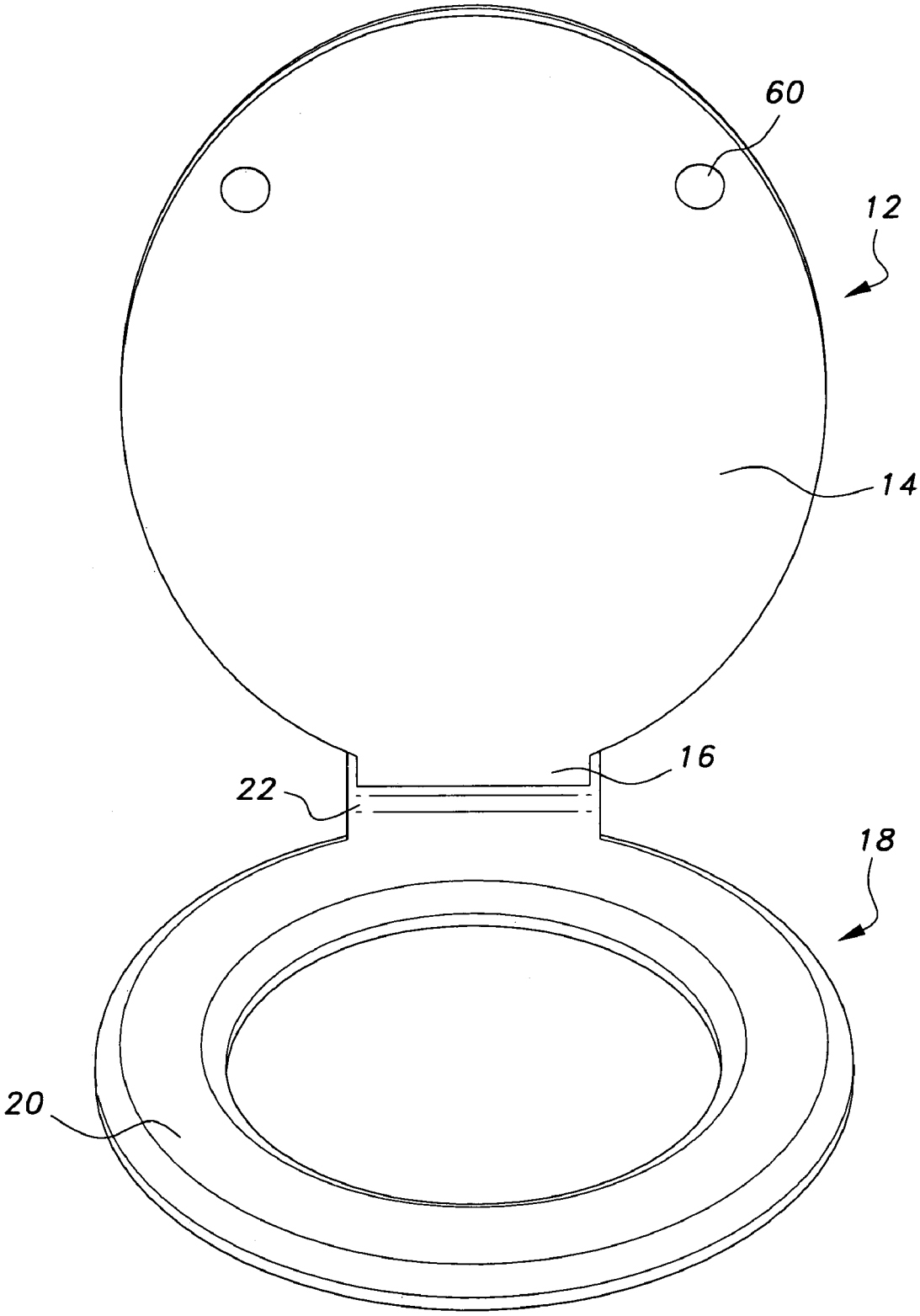
FIG. 4 is a front view of the toilet seat and seat lid of the toilet assembly according to the present invention.

Referring to FIG. 4, the toilet seat 18 and the toilet seat lid 12 are shown without the toilet bowl 50 and the toilet tank 40. The toilet seat lid 12 is lifted, illustrating that the hinge assembly 30 is covered when the lid 12 is raised such that the hinge assembly 30 may be protected from exposure to urine. The lid end portion 16 is extended off of the front lid portion 14 and covers a portion of the seat end portion 22.

Figure 5:
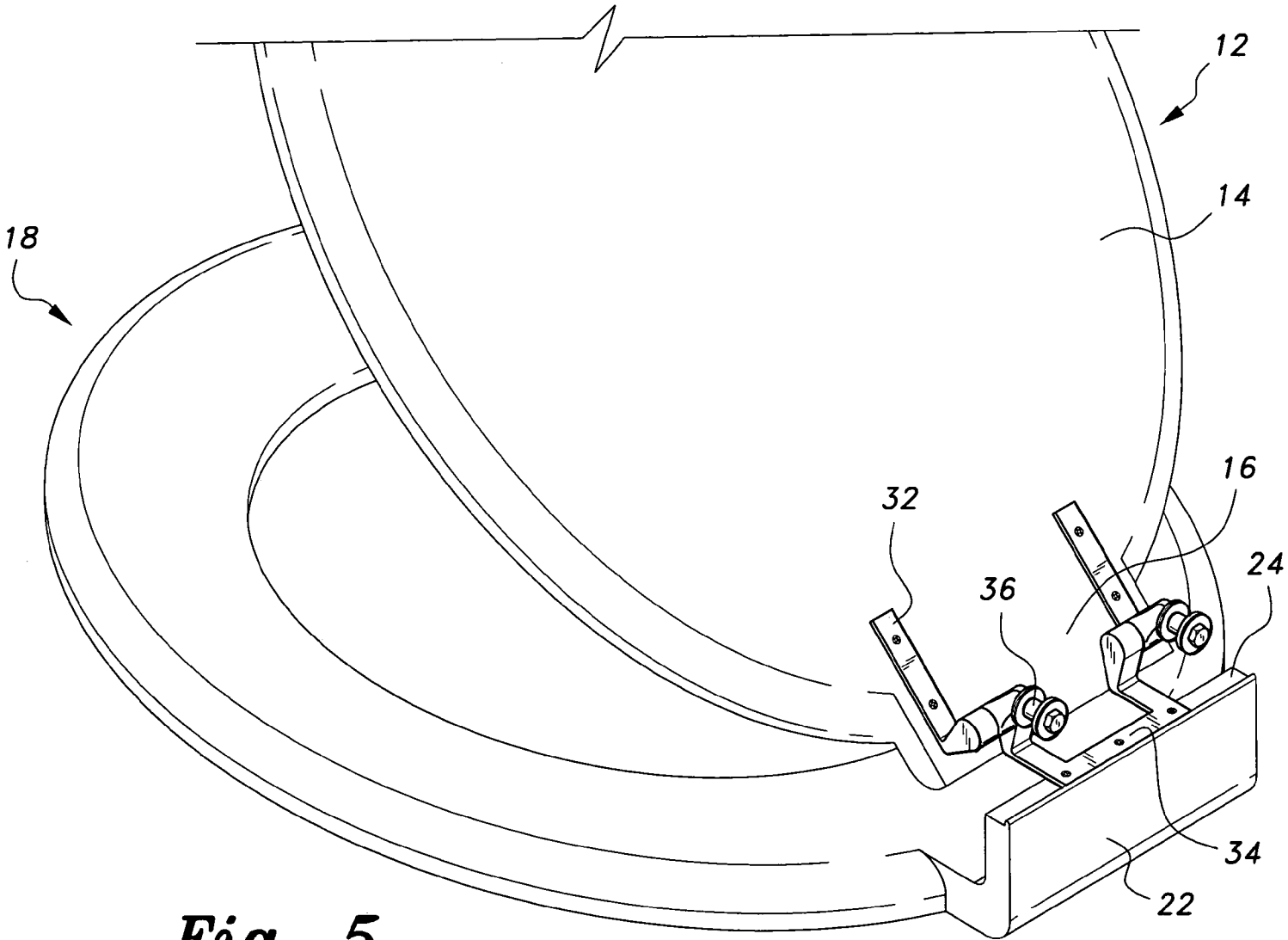
FIG. 5 is a rear perspective view of the toilet seat, toilet seat lid and hinge assembly according to the present invention.

FIG. 5 shows a rear view of the toilet seat 18, the toilet seat lid 12, and the hinge assembly 30. The hinge assembly 30 is affixed to the top surface 24 of the seat end portion 22 and the top of the lid end portion 16. The hinge bracket 34 is bolted to the top surface 24 of the seat end portion 22. One edge of the top surface 24 of the seat end portion 22 is raised slightly higher than the hinge bracket 34 to protect it against exposure to urine. The mounting attachments 36 extend off the middle of the pivot shafts 38. The hinge plates 32 extend off the end of the pivot shafts 38 and are attached to the toilet lid 12.

The toilet seat 18, toilet seat lid 12 and hinge assembly 30 may be an after-market attachment that is secured to an existing toilet bowl and toilet tank. The hinge assembly 30 is attached to the toilet seat 18 and toilet seat lid 12, then secured to the toilet tank by drilling holes in the existing tank.

It is to be understood that the present invention is not limited to the embodiment described above, but encompasses any and all embodiments within the scope of the following claims.

I claim:

1. A toilet seat assembly for use with a toilet bowl and a toilet tank, said toilet tank having a front surface, the toilet seat assembly comprising:

(a) a toilet seat lid having a front peripheral lid portion and a lid end portion extended off of the front peripheral lid portion;

(b) a toilet seat having a front peripheral seat portion and a seat end portion extended normal to the front peripheral seat portion, said seat end portion having a top surface at an elevation higher than the front peripheral seat portion; and (c) at least one hinge assembly adapted for attachment to the toilet tank, said at least one hinge assembly including a hinge bracket adapted for attachment to the top surface of the seat end portion, a plurality of hinge plates, and a plurality of mounting attachments, said plurality of hinge plates and said plurality of mounting attachments being connected to said hinge bracket, wherein an edge of the top surface of the seat end portion extends higher than said hinge bracket;

wherein said hinge assembly is attached to the lid end portion and the top surface of the seat end portion.

2. The toilet seat assembly according to claim 1, wherein said mounting attachments are adapted to be affixed to the front surface of the toilet tank.

3. The toilet seat assembly according to claim 1, wherein said hinge plates are attached to the lid end portion.

4. The toilet seat assembly according to claim 1, wherein the toilet seat lid has a plurality of lid spacers affixed thereon.

5. The toilet seat assembly according to claim 1, wherein the toilet seat has a plurality of seat spacers affixed thereon.

6. A toilet assembly, comprising:

(a) a toilet seat lid having a front peripheral lid portion and a lid end portion extended off of the front peripheral lid portion;

(b) a toilet seat having a front peripheral seat portion and seat end portion extended normal to the front peripheral seat portion, said seat end portion having a top surface at an elevation higher than the front peripheral seat portion;

(c) a toilet tank having a front surface;

(d) a toilet bowl having a base; and (e) at least one hinge assembly, said at least one hinge assembly including a hinge bracket attached to the top surface of the seat end portion, a plurality of hinge plates, and a plurality of mounting attachments, said plurality of hinge plates and said plurality of mounting attachments being connected to said hinge bracket, wherein an edge of the top surface of the seat end portion extends higher than said hinge bracket;

wherein the toilet tank is attached to the base of the toilet bowl; and wherein said hinge assembly is attached to the lid end portion, the top surface of the seat end portion and the toilet tank.

7. The toilet assembly according to claim 6, wherein said mounting attachments are affixed to the front surface of the toilet tank.

8. The toilet assembly according to claim 7, wherein the front surface of the toilet tank has a plurality of holes into which the mounting attachments are mounted.

9. The toilet assembly according to claim 6, wherein said hinge plates are attached to the lid end portion.

10. The toilet assembly according to claim 6, wherein the toilet seat lid has a plurality of lid spacers affixed thereon.

11. The toilet assembly according to claim 6, wherein the toilet seat has a plurality of seat spacers affixed thereon.

* * * * *